US007409724B2

(12) United States Patent
Murai

(10) Patent No.: US 7,409,724 B2
(45) Date of Patent: Aug. 12, 2008

(54) BASEBALL GLOVE

(75) Inventor: Hideaki Murai, Osaka (JP)

(73) Assignee: KSK Co., Ltd., Akune-shi (JP)

( * ) Notice: Subject to any disclaimer, the term of this patent is extended or adjusted under 35 U.S.C. 154(b) by 0 days.

(21) Appl. No.: 11/120,978

(22) Filed: May 4, 2005

(65) Prior Publication Data

US 2006/0162039 A1 Jul. 27, 2006

(30) Foreign Application Priority Data

Jan. 21, 2005 (JP) ..... 2005-013453

(51) Int. Cl.
*A63B 71/14* (2006.01)

(52) U.S. Cl. ..... 2/19; 2/16; 2/20; 2/21; 2/159; 2/161.1; 2/161.6; 2/163

(58) Field of Classification Search ..... 2/19, 2/16, 20, 21, 161.1, 159, 161.6, 163
See application file for complete search history.

(56) References Cited

U.S. PATENT DOCUMENTS 1,624,696 A * 4/1927 Turner ..... 2/19
1,964,175 A * 6/1934 Richey, Jr. ..... 2/19
4,665,561 A * 5/1987 Aoki ..... 2/19
6,289,516 B1 * 9/2001 Motooka et al. ..... 2/19
6,353,931 B1 * 3/2002 Gilligan et al. ..... 2/19
6,952,837 B1 * 10/2005 Aoki ..... 2/19

* cited by examiner

*Primary Examiner*—Gary L. Welch
*Assistant Examiner*—Alissa J Tompkins
(74) *Attorney, Agent, or Firm*—Kratz, Quintos & Hanson, LLP

(57) ABSTRACT

The present invention provides a baseball glove to absorb the impact force received by the thumb from the ball when catching, and the force received by the thumb from a runner when a touch playing, in a state in which the user experiences no strange sensation. A baseball glove, having a thumb pocket disposed inside the glove main body, and a thumb catching member disposed in the interior of the abovementioned thumb pocket, wherein a soft member which is constructed in a substantially tubular shape so as to cover the thumb that is inserted into this thumb pocket is disposed in the space in which the abovementioned thumb catching member is disposed within the internal space of the abovementioned thumb pocket with the dimension of this soft member in the longitudinal direction being set equal to or longer than the length dimension of this thumb catching member.

5 Claims, 6 Drawing Sheets

(a)

(b)

(a)

(b)

BASEBALL GLOVE

BACKGROUND OF THE INVENTION

1. Field of the Invention

The present invention relates to a baseball glove that can reliably absorb the impact force received by the thumb from the ball when the ball is caught, as well as the force received from the runner during a touch play made on such a runner, and which can be used without any strange feeling.

2. Description of the Related Art

In the abovementioned baseball glove, finger pockets constituting an inner skin are generally disposed inside a glove main body that constitutes an outer skin, and are devised so that the impact force from the ball during catching and the force received from the runner during a touch play can be absorbed to some extent by the finger pockets; however, depending on the speed of the ball and the magnitude of the force from the runner, it may not be possible to achieve sufficient absorption of these forces. Accordingly, a design is used in which flat sheet form cushioning materials are disposed in the finger pockets other than the thumb pocket so that the impact force from the ball during catching and the reaction force from the runner in the case of a touch play can be absorbed (for example, see Japanese Patent Application Laid-Open No. 10-113416, FIGS. 1, 2 and 7).

SUMMARY OF THE INVENTION

However, the baseball glove cushioning material described in the abovementioned Japanese Patent Application Laid-Open No. 10-113416 is provided in the finger pockets other than the finger pocket used for the thumb; in particular, no cushioning material that can protect the thumb and sufficiently absorb the impact force received from spikes is disposed in the thumb pocket, which is most susceptible to being spiked in cases where a touch play is made on a runner. Accordingly, there have been instances where the thumb has been injured.

Furthermore, since a thumb catching member that is used to receive the thumb in a specified position and restrict the thumb to this position is provided inside the thumb pocket, the end portion or the like of this thumb catching member contacts the thumb; as a result, the user experiences a strange sensation, so that there is room for improvement.

With the foregoing in view, it is an object of the present invention to make it possible to provide a baseball glove that can reliably absorb the impact force that is received by the thumb from the ball when the ball is caught, and the force that is received by the thumb from a runner when a touch play is made on this runner, and that can be used in a state in which the user experiences no strange sensation.

In order to solve the abovementioned problems, the present invention is a baseball glove in which a thumb pocket is disposed inside the glove main body, and a thumb catching member is disposed in the interior of the abovementioned thumb pocket, wherein a soft member which is constructed in a substantially tubular shape so as to cover the thumb that is inserted into the abovementioned thumb pocket is disposed in the space in which this thumb catching member is disposed within the internal space of the abovementioned thumb pocket with the dimension of this soft member in the longitudinal direction being set equal to or longer than the length dimension of the abovementioned thumb catching member.

Since a soft member which is constructed in a substantially tubular shape, and in which the dimension in the longitudinal direction is set equal to or longer than the length dimension of the thumb catching member, is disposed in the interior of the thumb pocket, substantially the entire circumference of the thumb that is inserted into the thumb pocket can be covered; accordingly, not only is there no contact of the end portion of the thumb catching member with the thumb, but the impact force that is received from the ball when the ball is caught and the force that is received from a runner when a touch play is made on such a runner can be reliably absorbed and alleviated regardless of the angle from which such forces act on the thumb. Besides a state in which the shape is a perfectly cylindrical shape, the abovementioned term "substantially tubular" also includes states in which the shape is close to cylindrical, i.e., states in which some gap is generated between the end parts in the circumferential direction. This term "some gap" refers to a gap of a size which is such that there is no contact with the thumb pocket or thumb catching member when the thumb is covered by the soft member. Furthermore, the soft member may also be a member in which only one end, i.e., the end into which the thumb is inserted, is open, with the other end being closed. Moreover, the abovementioned baseball glove may be a general glove (gloves of types including hard use, soft use, softball use or the like), a glove comprising only two finger pockets, i.e., one pocket for the thumb and one pocket for all of the other four fingers together, or the like; i.e., as long as the glove has finger pockets, there is no restriction on the number of these finger pockets.

The abovementioned soft member may be a member in which a cushioning material consisting of a sponge or felt is sandwiched and integrated between two sheet materials consisting of leather or cloth.

The thumb insertion beginning end portion of the abovementioned substantially tubular soft member that contacts the underside of the thumb may be folded back to the outside in a state in which the thumb is inserted into this soft member.

The abovementioned thumb pocket may be formed into a pocket shape by stitching, or by joining by means of an adhesive agent, at least two sheet members, and the abovementioned thumb catching member may be fastened to a cord for fastening the abovementioned thumb pocket to the abovementioned glove main body by causing the cord to pass through the abovementioned glove main body after passing from one of the abovementioned sheet members through the other sheet member.

As a result of a soft member which is constructed in a substantially tubular shape and in which the dimension in the longitudinal direction is set equal to or longer than the length dimension of the thumb catching member being disposed in the interior of the thumb pocket, substantially the entire circumference of the thumb that has been inserted into the thumb pocket can be covered. Accordingly, not only is there no contact of the end portion of the thumb catching member being disposed in the interior of the thumb pocket with the thumb, but the impact force that is received from the ball when the ball is caught and the force that is received from a runner when a touch play is made on such a runner can be reliably absorbed and alleviated regardless of the angle from which such forces act on the thumb, so that a baseball glove and baseball glove shock absorbing material that can be used in a favorable manner can be provided.

If the soft member is constructed from a member in which a cushioning material consisting of a sponge or felt is sandwiched and integrated between two sheet materials consisting of natural leather, synthetic leather or cloth, the cushioning effect can be heightened compared to a case in which (for example) this member is constructed from only a single sheet of natural leather, synthetic leather or cloth; accordingly, not only can the impact force received by the thumb from the ball when the ball is caught and the force received by the thumb from a runner when a touch play is made on such a runner be absorbed more effectively, but a superior feeling during use can be obtained.

If the thumb insertion beginning end portion of the soft member that contacts the underside of the thumb may be folded back to the outside in a state in which the thumb is inserted into this soft member, the thumb insertion beginning end of the soft member that contacts the underside of the thumb can be rounded, so that the glove can be used without experiencing any strange sensation.

BRIEF DESCRIPTION OF THE DRAWINGS

FIG. 4(*b*) is sectional view of the soft member;

FIG. 5(*b*) is a perspective view of the internal sheath; and

DESCRIPTION OF THE PREFERRED EMBODIMENTS

Figure 1:
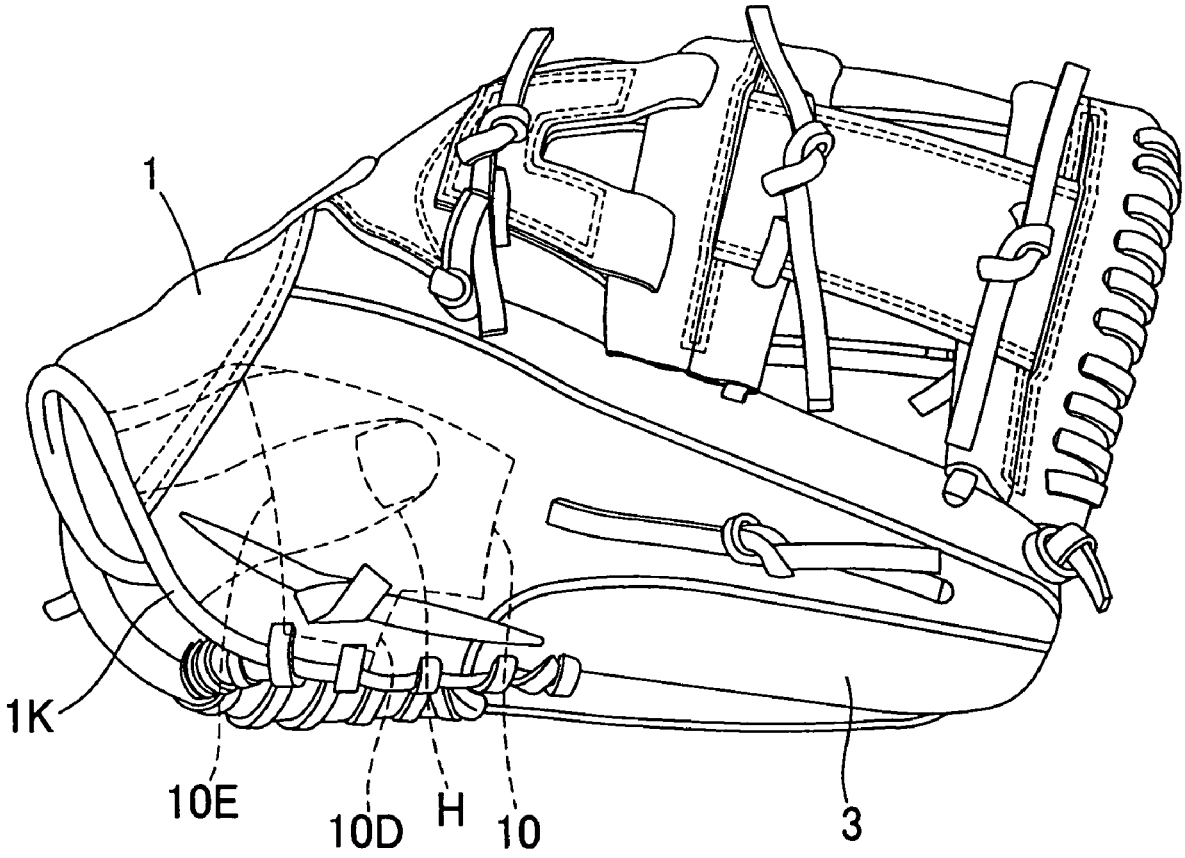
FIG. 1 is a side view of the baseball glove.
Figure 2:
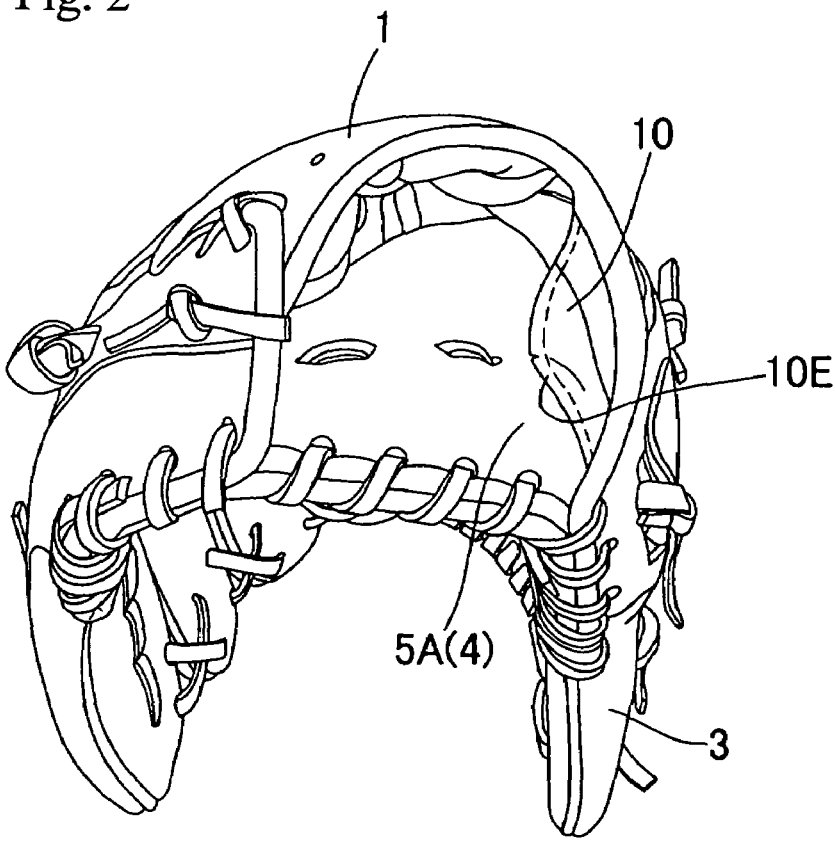
FIG. 2 is a bottom view of the baseball glove.

The baseball glove is shown in FIGS. 1 and 2. This baseball glove has an external sheath which forms the ball catching surface and which forms the glove main body, and an internals heat (shown in FIGS. 5(*a*) and 5(*b*); only the thumb portion is shown in the figures) which is disposed inside this external sheath 1, and which is used to maintain and adjust the shape of the glove. It is generally desirable that each of these sheaths, i.e., the external sheath 1 and internal sheath 2, be constructed from natural leather, synthetic leather, artificial leather or a material of substantially the same nature as these materials; however, these sheaths may be constructed from other materials. Furthermore, the abovementioned external sheath is not limited to the shape and construction shown in the figures. For example, in the figures, the external sheath consists of an external sheath 1 for five fingers; however, besides a sheath constructed from two or three finger pockets, the sheath may also consist of a sheath other than that for an ordinary glove of the type shown in the figures, e.g., a catcher's mitt, first-base mitt or the like. Furthermore, the glove shown in the figures is a glove worn on the left hand; however, the present invention may also be applied to a glove worn on the right hand.

Figure 5:
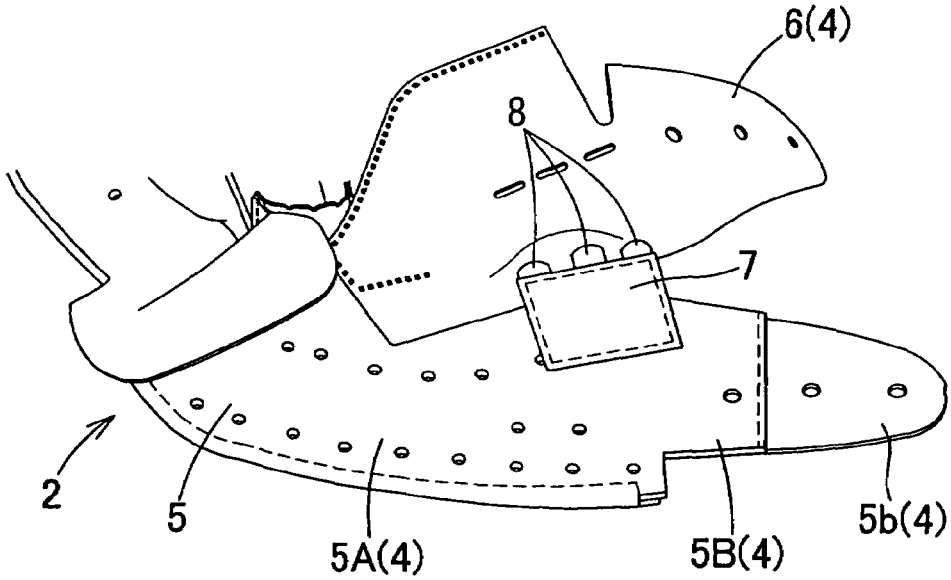
FIG. 5(*a*) is an unfolded view (with a portion of the internal sheath omitted) showing the attachment part of the thumb catching member.
Figure 5:
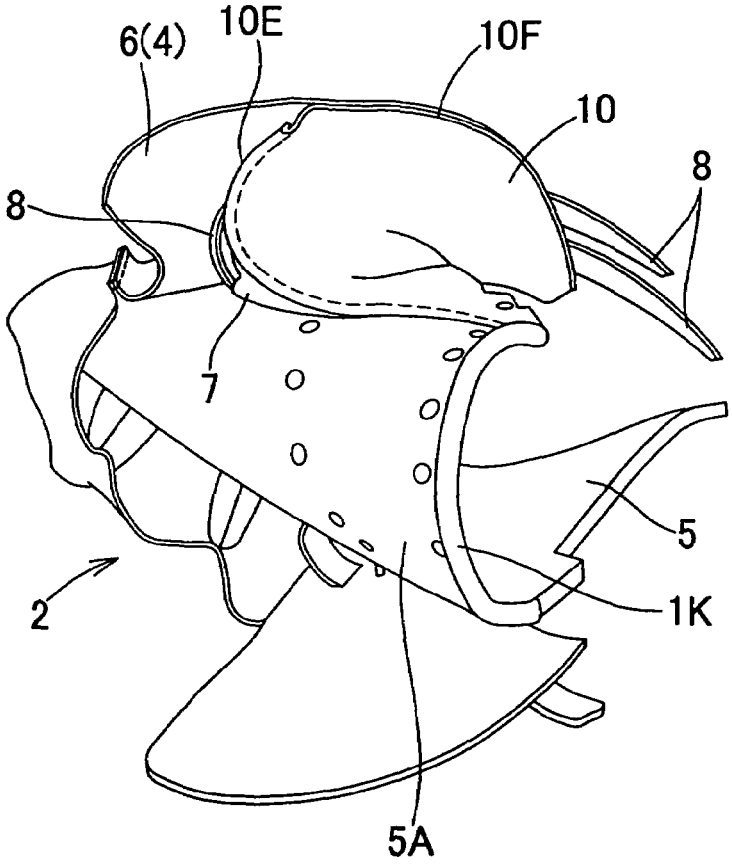

As is shown in FIGS. 5(*a*) and 5(*b*), the thumb pocket 4 constituting a portion of the abovementioned internal sheath 2 that is disposed inside the abovementioned external thumb pocket 3 constituting a portion of the external sheath 1 consists of the ball catching surface part 5A of a first sheet member 5 in which a flat sheet form ball catching surface part 5A and five flat sheet form finger parts are manufactured from a single sheet of natural leather, synthetic leather or the like, a thumb part 5B that extends from this ball catching surface part 5A, a flat sheet form auxiliary tip end part 5*b* that is installed as an extension on this thumb part 5B, and that is manufactured from natural leather, synthetic leather or the like, and a flat sheet form second sheet member 6 manufactured from a single sheet of natural leather, synthetic leather, artificial leather or the like used for construction into a pocket shape by overlapping and stitching a portion of the abovementioned ball catching surface part 5A, the thumb part 5B and the tip end part 5*b*; however, the materials, shapes and concrete constructions of these parts may be other constructions.

As is shown in FIGS. 5(*a*) and 5(*b*), a substantially rectangular sheet form thumb catching member 7 which is used for contact restriction of the thumb to the proper position by contacting the underside of the inserted thumb is disposed on the index finger pocket side of the internal space of the abovementioned internal thumb pocket 4 (at the beginning end with respect to the thumb insertion direction). This thumb catching member 7 can be constructed using natural leather, synthetic leather, artificial leather, cloth, a soft resin or the like. Furthermore, three cords (consisting of natural leather, synthetic leather, artificial leather, cloth or the like) 8 which are stitched at one end to the ball catching surface side of the ball catching surface part 5A of the first sheet member 5 are caused to pass through this ball catching surface part 5A at the other end, and are then caused to pass through the abovementioned thumb catching member 7; next, these cords 8 are fastened to the external sheath 1 by stitching after further being caused to pass through the second sheet member 6. However, it would also be possible to construct the thumb catching member 7 from cords alone, or to fasten this member 7 inside the internal thumb pocket 4 in a state independent of the cords. Furthermore, in FIG. 5(*a*), the two parts are fastened by stitching (an adhesive agent may also be used) in a state in which three cords 8 are passed through the thumb catching member 7; however, it would also be possible to fasten the two parts by stitching (an adhesive agent may also be used) in an abutting state without passing these three cords 8 through the thumb catching member 7.

A soft member 10 is disposed as a shock absorbing member constructed in a tubular shape so as to cover the thumb H that is inserted into the abovementioned thumb pocket 4 in the area where the thumb catching member 7 is disposed in the internal space of the abovementioned internal thumb pocket 4. The dimension of this soft member 10 in the longitudinal direction is set longer than the length dimension of the abovementioned thumb catching member 7 (in some cases, this dimension may be set at the same length as that of the thumb catching member 7) Accordingly, when the thumb is inserted into the internal thumb pocket 4, as is shown in FIGS. 1 and 3, a state is produced in which the thumb H is covered by the soft member 10, so that any external force acting on the internal thumb pocket 4 can be reliably absorbed regardless of the direction from which this force is applied (including of course the contact of the end of the thumb catching member 7 with the thumb H).

Figure 3:
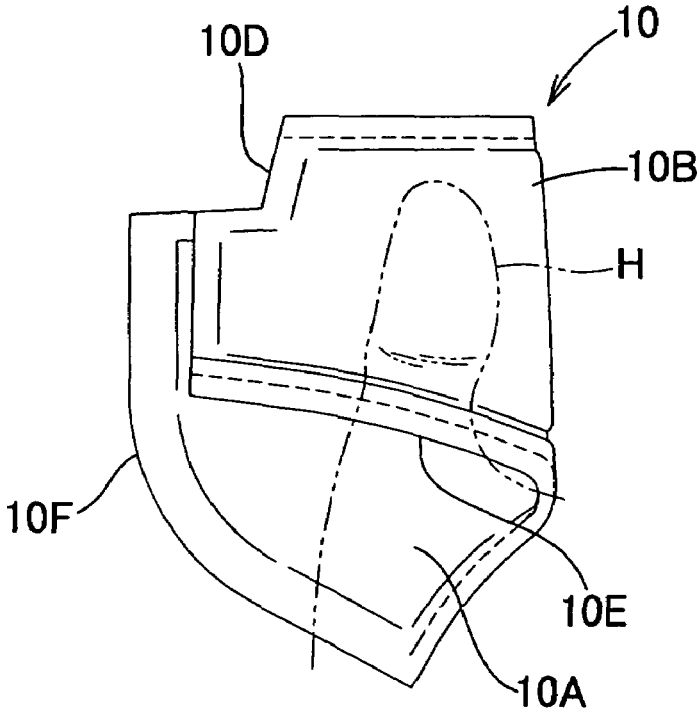
FIG. 3 is a view of the soft member as seen from the side of the ball catching surface.
Figure 4:
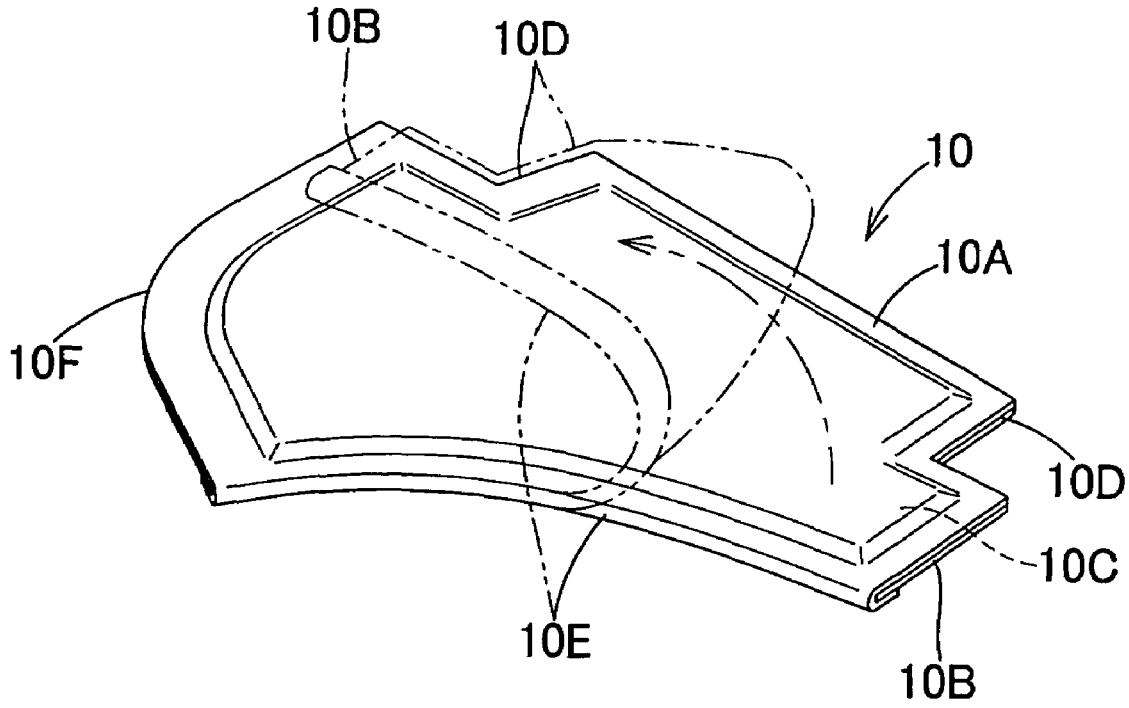
FIG. 4(*a*) is a perspective view of the soft member.
Figure 4:
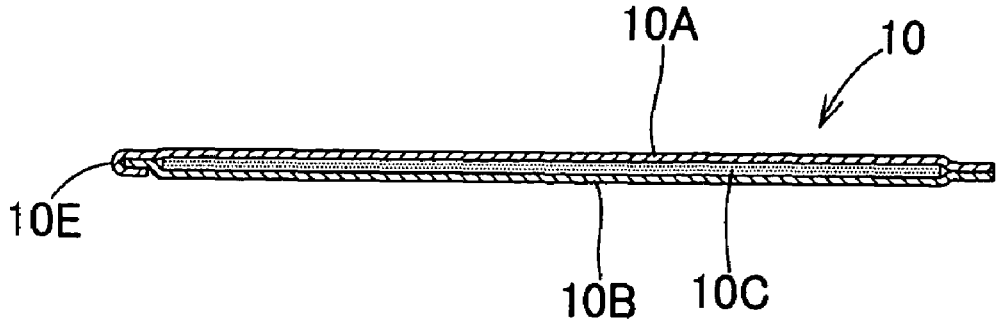
Figure 6:
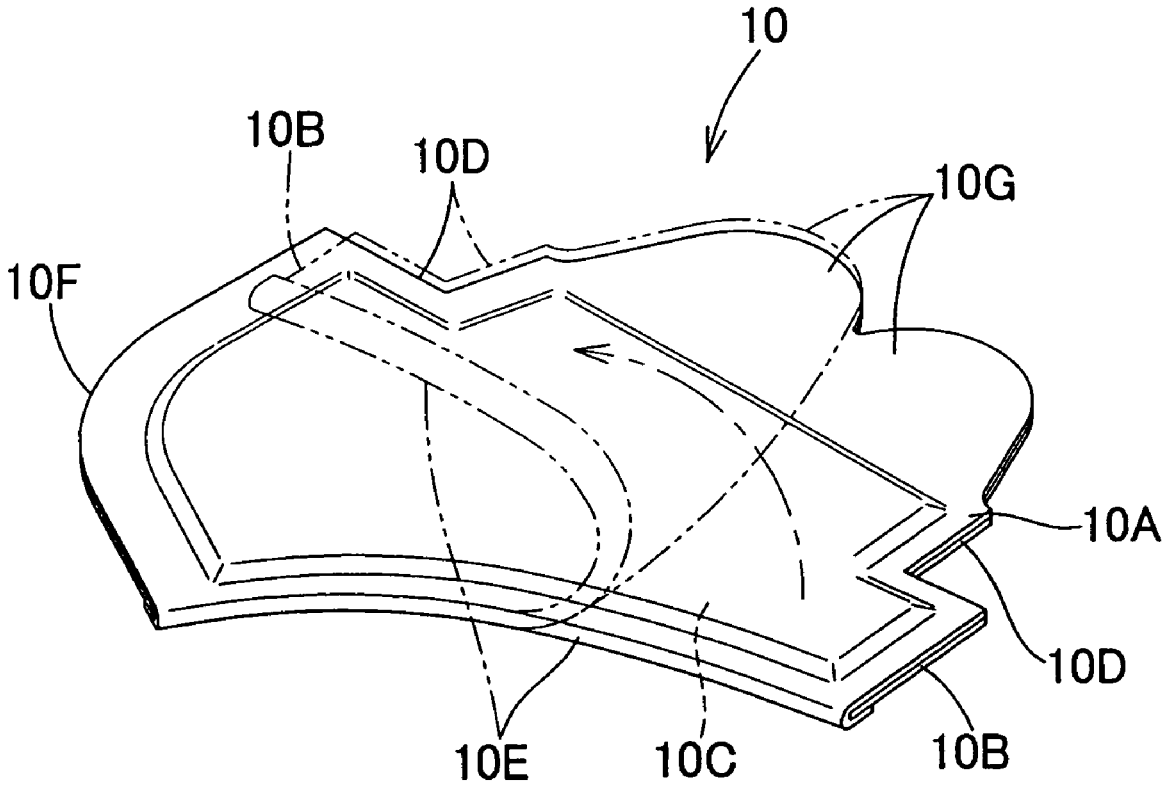
FIG. 6 is a perspective view of another soft member.
Figure 7:
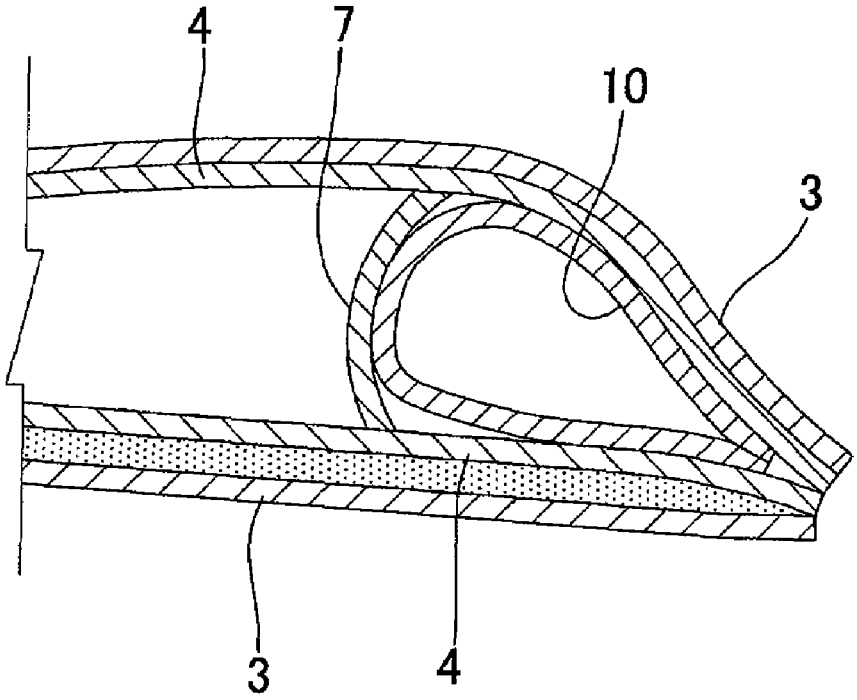
FIG. 7 is a partial sectional view of the baseball glove.

As is shown in FIG. 3 and FIGS. 4(*a*) and 4(*b*), the abovementioned soft member 10 is integrated by sandwiching a cushioning material 10C consisting of a sponge or felt between two sheet members 10A and 10B consisting of natural leather, synthetic leather, artificial leather, cloth or the like, and stitching the outer circumferential edge (an adhesive agent may also be used). Furthermore, the abovementioned soft member 10 consisting of three layers is formed into a tubular shape by overlapping both ends of this member 10, and connecting these ends by stitching or by using an adhesive agent. By thus sandwiching the cushioning material 10C between sheet members 10A and 10B, it is possible to increase the durability of the soft member 10 against wear caused by friction with the thumb; however, this soft member 10 may also be constructed from a single sheet of a material that has cushioning properties. The system is devised so that the tubular soft member 10 constructed as described above can be sandwiched as described above when this soft member 10 is inserted into the internal thumb pocket 4 or when the internal thumb pocket 4 is manufactured, and so that this member can be mounted and fastened by stitching specified locations on both parts or by using an adhesive agent. In order to cause the abovementioned soft member 10 to conform to the external shape of the external sheath 1, and prevent any protrusion from the external sheath 1, this member 10 is constructed substantially in a fan shape which has two step parts 10D and a circular arc part 10E, and insertion of the thumb is facilitated by forming the member 10 into a tubular shape in which the diameter decreases toward the tip end in the direction of thumb insertion; however, it would also be possible to form this member 10 in a rectangular shape, polygonal shape or the like. Here, furthermore, a tubular member is shown. In some cases, however, it would also be possible to dispose the soft member 10 on the external sheath 1 in a state in which the two ends are not joined to form a tubular shape, and in which some gap is generated between the two ends that would be joined. Furthermore, in cases where the soft member 10 is manufactured using a foaming soft resin or the like, the soft member 10 can be formed in a tubular state without any need to join the two ends. Moreover, the thickness and size of the soft member 10 can be set at any desired values, as long as the thumb can be favorably covered. For example, as is shown in FIG. 6, two circular arc parts 10G that extend further in a circular arc shape from the final end part (with respect to the direction of insertion of the thumb H) of the soft member 10 may be provided, so that the dimension of the tubular soft member 10 in the longitudinal direction is further lengthened. The present invention may also be worked by an embodiment in which the final end part of the abovementioned soft member 10 (with respect to the direction of insertion of the thumb H) is closed off by stitching or by means of an adhesive agent.

The thumb insertion beginning end portion of the soft member 10 that contacts the underside of the thumb in a state in which the thumb is inserted into the abovementioned tubular soft member 10 is folded back to the outside. In other words, as a result of one of the sheet members 10A of the soft member 10 being formed with an external shape dimension that is slightly larger than that of the other sheet member 10B, the protruding end portion of the larger sheet member (positioned on the inside) 10A can be folded in on the outer surface side of the smaller sheet member 10B, so that the thumb insertion beginning end portion or the abovementioned circular arc part 10E can be formed into a curved part with an angle; consequently, even if the underside of the thumb should contact this thumb insertion beginning end portion 10E, the experiencing of a strange sensation by the user can be prevented. The reason that the thumb insertion beginning end portion 10F on the side contacted by the back side (nail side) of the abovementioned thumb is not formed into a curved part as described above is as follows: namely, since this portion is positioned so as to connect with the curved part at a point preceding the curved part 1K disposed on the end portion of the external sheath 1, the back side (nail side) of the thumb H does not contact the thumb insertion beginning end portion 10F; accordingly, there is no need to form a curved part such as that described above.

What is claimed is:

1. A baseball glove having a thumb pocket disposed inside the glove main body, a soft member disposed in the thumb pocket, the soft member being constructed separately from the thumb pocket; the soft member being constructed in a substantially tubular shape so as to cover a thumb; and a thumb catching member disposed in the interior of said thumb pocket, wherein the soft member is formed from a multilayered material comprising a cushioning material sandwiched between two sheet members; the multilayered material is formed into a substantially tubular shape by overlapping both ends of the multilayered material and connecting these ends by stitching or by using an adhesive agent;

a thumb is inserted into the soft member so that the thumb does not come into direct contact with the thumb pocket; and the soft member and the thumb catching member are disposed within the thumb pocket so that the internal space of the thumb pocket in relation to the dimension of the soft member in the longitudinal direction is set equal to or longer than the length dimension of the thumb catching member.

2. The baseball glove according to claim 1, wherein said soft member is a member in which a cushioning material consisting of a sponge or felt is sandwiched and integrated between two sheet materials consisting of leather or cloth.

3. The baseball glove according to claim 1 or claim 2, wherein the thumb insertion beginning end portion of said substantially tubular soft member that contacts the underside of the thumb is folded back to the outside in a state in which the thumb is inserted into this soft member.

4. The baseball glove according to claim 1 or claim 2, wherein said thumb pocket is formed into a pocket shape by stitching, or by joining by means of an adhesive agent, at least two sheet members, and said thumb catching member is fastened to a cord for fastening said thumb pocket to said glove, main body by causing the cord to pass through said glove main body after passing from one of said sheet members through the other sheet member.

5. The baseball glove according to claim 1, wherein the soft member is formed from a single layer having cushioning properties.

* * * * *